US005589843A

United States Patent [19]

Meredith et al.

[11] Patent Number: 5,589,843

[45] Date of Patent: Dec. 31, 1996

[54] ANTENNA SYSTEM WITH TAPERED APERTURE ANTENNA AND MICROSTRIP PHASE SHIFTING FEED NETWORK

[75] Inventors: Sheldon K. Meredith; Pitt W. Arnold, both of Phoenix, Ariz.; Warren F. Hunt, Lakewood; Kevin J. Connolly, Freehold, both of N.J.; Kevin M. Gaukel, Tempe, Ariz.

[73] Assignee: Radio Frequency Systems, Inc., Marlboro, N.J.

[21] Appl. No.: 365,590

[22] Filed: Dec. 28, 1994

[51] Int. Cl.[6] ..... H01Q 9/16

[52] U.S. Cl. ..... 343/820; 343/813; 343/814; 343/816; 343/810

[58] Field of Search ..... 343/820, 700 MS, 343/850, 853, 810, 812, 813, 814, 816, 792, 793

[56] References Cited

U.S. PATENT DOCUMENTS

| | | | |
|---|---|---|---|
| 3,474,447 | 10/1969 | Melancon | 342/371 |
| 3,701,157 | 10/1972 | Uhrig | 343/797 |
| 3,836,970 | 9/1974 | Reitzig | 342/352 |
| 3,858,218 | 12/1974 | Masak et al. | 342/406 |
| 3,997,900 | 12/1976 | Chin et al. | 343/705 |
| 4,032,922 | 6/1977 | Provencher | 342/373 |
| 4,062,019 | 12/1977 | McDonald et al. | 343/797 |
| 4,063,243 | 12/1977 | Anderson et al. | 343/876 |
| 4,231,040 | 10/1980 | Walker | 342/373 |
| 4,316,192 | 2/1982 | Acoraci | 342/373 |
| 4,495,502 | 1/1985 | Masak | 342/380 |
| 4,596,986 | 6/1986 | Andrews et al. | 343/373 |
| 4,633,257 | 12/1986 | Apostolos et al. | 342/445 |
| 4,882,588 | 11/1989 | Renshaw et al. | 342/373 |
| 4,905,014 | 2/1990 | Gonzalez et al. | 343/700 MS |
| 5,115,248 | 5/1992 | Roederer | 342/373 |
| 5,255,004 | 10/1993 | Berkowitz et al. | 343/810 |
| 5,353,032 | 10/1994 | Bertocchi et al. | 206/387.13 |

*Primary Examiner*—Hoanganh T. Le
*Attorney, Agent, or Firm*—Ware, Fressola, Van Der Sluys & Adolphson

[57] ABSTRACT

An improved antenna system for use at high frequencies such as cellular communication and PCS frequencies, having a steerable, multi co-linear array antenna in which the number of radiating elements per co-linear array increases monotonically from the periphery of the antenna to the middle of the antenna, and wherein the antenna is connected to a Butler matrix feed network, thereby providing steerability of the radiation pattern associated with the antenna. The improved antenna system achieves significantly lower sidelobe generation as compared to antenna systems using multiple co-linear arrays of radiating elements in which the number of radiating elements per co-linear array is constant. The Butler matrix feed network is implemented via a microstrip fabricated printed circuit board without cross-overs.

15 Claims, 10 Drawing Sheets

ANTENNA SYSTEM WITH TAPERED APERTURE ANTENNA AND MICROSTRIP PHASE SHIFTING FEED NETWORK

TECHNICAL FIELD

The present invention is directed to antenna systems having antenna arrays and feed mechanisms for use therewith, particularly where such antenna systems are used for cellular communications, personal communication systems, and other high frequency applications.

BACKGROUND OF THE INVENTION

In the cellular communication art, land mobile radio networks transmit and receive high frequency signals (greater than 800 MHz) via antennas located at land mobile sites. In order to maximize the geographic area for coverage of the signal, the effective radiated power (ERP) must be maximized. The ERP is the product of the power input to the antenna times the gain factor of the antenna; that is, the solid angle direction of the transmission and reception path of the antenna.

It is known in the art that in order to have high ERP while reducing the absolute power into the antenna, the antenna must necessarily have a high gain factor. In order to increase the gain of an antenna, the physical aperture, that is the height and width of the antenna, must increase and the antenna's beam as defined by the solid cone angle, must necessarily occupy fewer steradians. Thus for instance, an antenna might have a vertical beamwidth of 4°, while the horizontal beamwidth may be 30°. These beamwidths thus define the antenna's radiating beam solid cone angle. Typically the smaller the beam solid cone angle, the higher the gain of the antenna.

For cellular communication applications, it is generally required, depending upon the location of the land mobile radio site, to cover 360° of azimuth while the vertical beamwidth may only be 4° in order to effectively cover a geographic area. However, in order to cover 360° of azimuth and maintain high gain, it is typically necessary to use twelve antennas with 30° of horizontal beamwidth each. Of course the cost of such antennas and the availability of mounting space for such antennas present significant difficulties. Furthermore, this number of antennas can present wind loading problems at the antenna tower, as well as provide a detrimental visual appearance.

The use of narrow, azimuthal-beam antennas has been quite limited with respect to the land mobile radio industry. One fairly early method of producing multiple antenna patterns out of a common aperture has been employed using a technique called a Butler-matrix feed. Such a matrix consists of a phasing network with N inputs and N outputs, where N can be any integer number greater than one. This phasing network serves to take each of the N inputs and divide the signal amongst the N output ports with each output port having a fixed phase offset with respect to the other output ports. By properly adjusting the phases between adjacent antennas, the output lobe from the antenna can be electrically steered to the left or fight in a controlled fashion. Each of the N inputs creates a different set of phase shifts on the N outputs and therefore results in N distinct "beams" from a common aperture. FIG. 1 illustrates an example of this phase shifting arrangement for eight inputs and eight outputs (N=8). A discussion of the Butler-matrix feed is presented in "Antenna Engineering Handbook", Second Edition, Richard C. Johnsen and Henry Jasick, McGraw-Hill Book Company. pp. 20–56 through 20–60.

Since it is not necessary to have separate antenna apertures to make all of the required antenna beams, the Butler-matrix feed approach greatly reduces the problems associated with the visual appearance of a plurality of antennas, with the concomitant reduction in wind loading, as well as some cost savings with regard to mounting space. One approach for an antenna driven by such a Butler-matrix is shown in FIG. 2, which illustrates four sets of four co-linear arrays of radiating elements, yielding a 4×4 panel of radiating elements.

SUMMARY OF THE INVENTION

The beamwidths, sidelobe levels and grating lobes of an antenna comprising N co-linear arrays of N radiating elements driven by an N beam Butler-matrix feed are defined by the physics of the overall antenna system. Thus the spacing between the co-linear arrays of radiating elements (in wavelengths of the radiating or received energy) drive the grating lobes while the sidelobes are driven by the spacial Fourier transform of the antenna aperture width and the radiating element spacing within each of the co-linear arrays. For four vertically polarized co-linear arrays of radiating elements at 0.5 wavelength horizontal spacing (between adjacent arrays), the sidelobes are approximately 7 dB below the main lobe. Even if the number of co-linear elements per array is increased vertically, such as to 8, such an arrangement does not change the sidelobe level relative to the main lobe. A-7 dB sidelobe is a significant problem for cellular communications due to the fact that it does not provide the azimuthal beam pattern required for land mobile radio system operation.

It has been shown through use of Monte Carlo analysis programs conducted at U.S. West New Vector Group in Bellevue, Wash. that −10 dB sidelobe levels are the maximum levels which can be adequately tolerated for such land mobile radio system operation. Thus, the standard arrangement of an antenna with four co-linear arrays of four radiating elements each, connected to a Butler-matrix feed is not suitable for such communication. Although attenuation of the power levels associated with the exterior beams of the four array antenna is possible in order to reduce the sidelobe levels, such an arrangement is not practical due to heat dissipation if non-active elements are to be used at the antenna site.

The essence of the present invention is to decrease the sidelobe levels to below −10 dB by reducing the number of co-linear radiating elements at the outer edges of the multi-co-linear array antenna and to drive the resulting ant Butler-matrix network feed. In such an arrangement, the absolute gain of the antenna decreases slightly because the physical aperture is slightly smaller.

The reduction of the number of co-linear elements for the co-linear arrays toward and at the edges of the antenna is sometimes referred to as space tapering. Such space tapering is highly desirable with regard to the reduction of sidelobe levels. It has been experimentally found that for four co-linear arrays having respectively 2, 4, 4, 2 radiating elements, the sidelobe levels decrease from −7 dB to approximately −12 dB or lower. Such an arrangement results in a 5 dB improvement over that which is achievable with standard 4×4 array antennas and meets the initial requirements of the land mobile radio industry.

Thus a primary inventive aspect of the present invention is the use of a microstrip implemented Butler-matrix feed network in combination with an antenna using space tapering in order to achieve a high gain antenna with reduced sidelobe levels which is particularly advantageous for use in land mobile radio applications, including cellular radio communications and PCS communications.

BRIEF DESCRIPTION OF THE DRAWINGS

For fuller understanding of the nature and objects of the present invention, reference is made to the following detailed description taken in combination with the following drawings in which.

BEST MODE FOR CARRYING OUT THE INVENTION

Figure 1:
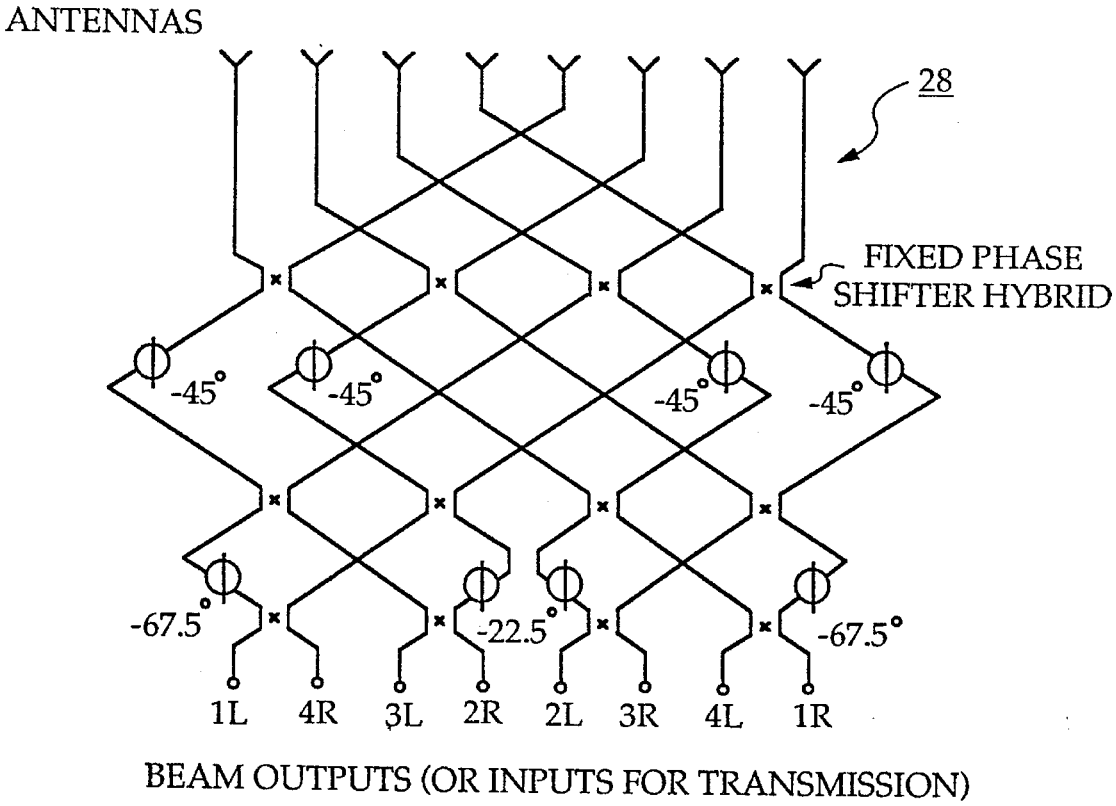
FIG. 1 PRIOR ART
FIG. 1 illustrates a prior art Butler-matrix feed network comprising N inputs and N outputs, where N is equal to 8.
Figure 2:
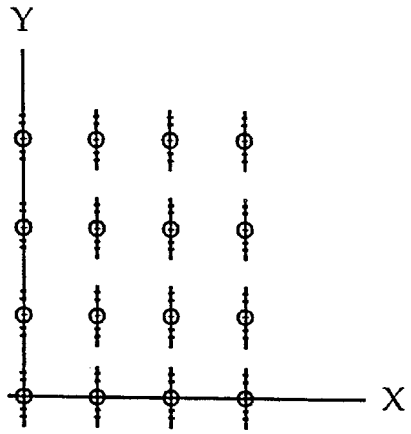
FIG. 2 PRIOR ART
FIG. 2 is a diagrammatic representation of a prior art antenna with four co-linear arrays, in which each co-linear array comprises four radiating elements.
Figure 3:
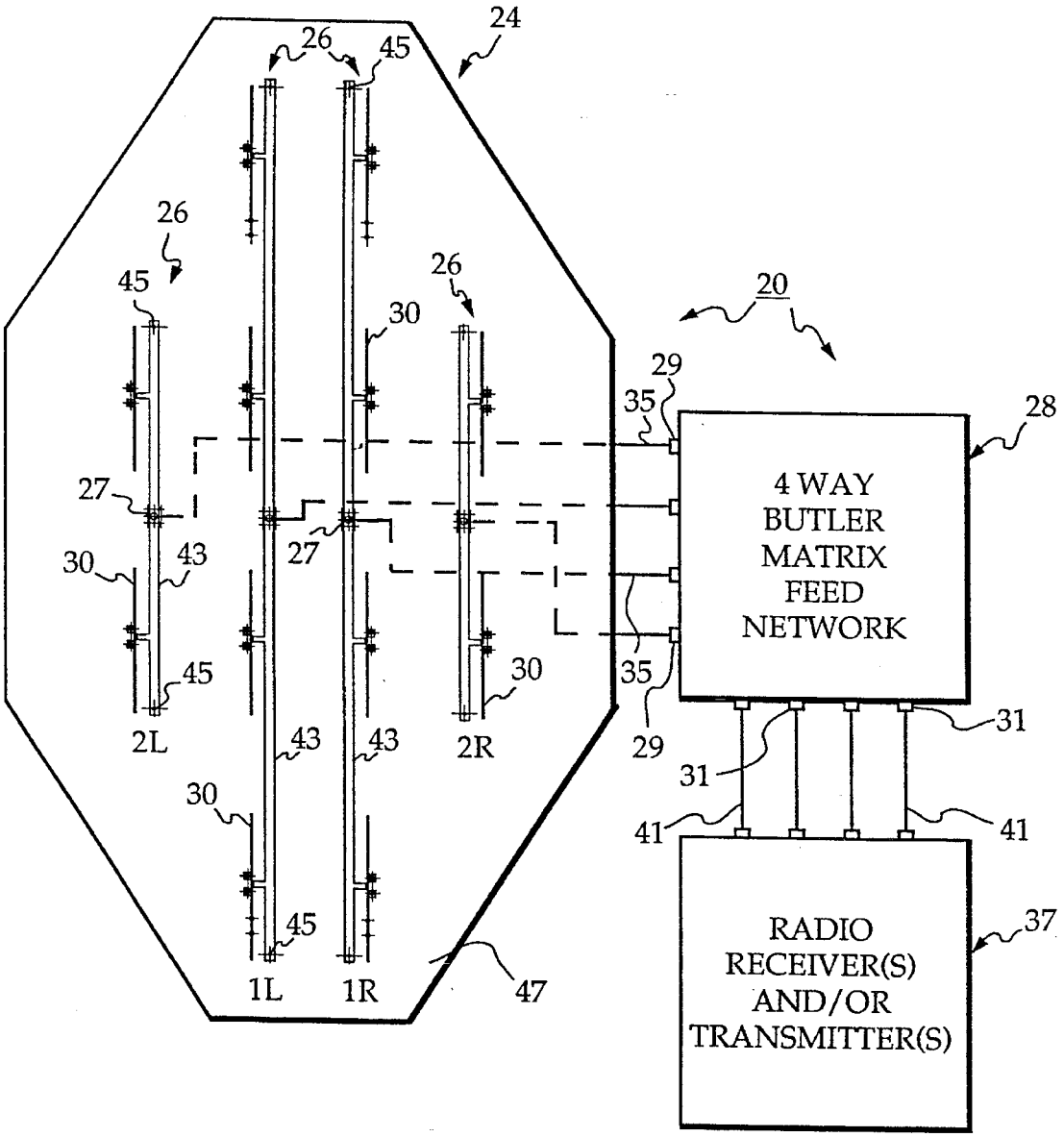
FIG. 3 is a diagrammatic representation of an embodiment of an antenna system according to the present invention, illustrating a space-tapered antenna, comprising four co-linear arrays, wherein the outermost co-linear arrays each have two radiating elements, and wherein the inner arrays each have four radiating elements, a 4-way Butler matrix feed network forming part of the antenna system; and radio receiver(s) and/or transmitter(s) connected to the Butler matrix feed network, the receiver(s) and/or transmitter(s) not forming part of the antenna system.

As best seen in FIG. 3, the present invention is directed to an improved antenna system 20 which comprises two major components; namely, a space tapered multi-beam antenna 24 and a Butler-matrix feed network 28. The embodiment of the antenna shown in FIG. 3 comprises four co-linear arrays 26 of associated electromagnetic radiating elements 30. These radiating elements are typically dipole elements, although other types of radiating element can be used. The 4-way Butler matrix feed network 28 has four antenna ports 29 and four radio receiver/transmitter ports 31. The antenna ports 29 are each connected to one co-linear array 26 by cables 35 and connectors 27 associated with each array, while the receiver/transmitter ports 31 are connected to radio receiver and/or radio transmitter equipment 37 by cables 41. Cables 35 are equal phase cables so as not to introduce any phase change with respect to the signals carried thereover relative to the other cables 35. Cables 41 need not be equal phase cables since any phase changes introduced by these cables is not relevant to the electronic beam(s) being used. The radio receiver/transmitter equipment is shown generally in FIG. 3, since the specific type of equipment used in an actual installation can vary widely.

As also seen in FIG. 3, the outermost co-linear arrays (denoted 2L and 2R where L=left and R=right) each comprise two radiating elements, while the innermost arrays (denoted 1L and 1R) each comprise four radiating elements. The spacing between adjacent elements 30 in a co-linear array is preferably approximately $\lambda$, where $\lambda$ is the wavelength of the electromagnetic energy to be received or transmitted. The spacing between adjacent co-linear arrays, such as between arrays A and B, is typically approximately $\lambda/2$ ($0.47\lambda$ for the embodiment shown in FIG. 3).

In general, the Butler-matrix feed network 28 has N antenna ports 29 and N receiver/transmitter equipment ports 31, where N is equal to the number of co-linear arrays of the associated antenna.

As seen in FIG. 3, each radiating element 30 is, in this preferred embodiment, a dipole radiating element. Energy is radiated or received from these dipole elements by means of a feed strap 43 having a centrally located connector 27. The dipole elements are spaced from each adjacent dipole element of the same array by a distance approximately equal to $\lambda$. The feed strap includes portions 45 extending beyond the lowermost and uppermost dipole element, with the end of these portions connected to the electrically conductive back plate 47 of the antenna. Such a feed strap configuration is known in the art as a Bogner type feed (see U.S. Pat. No. 4,086,598).

Figure 4:
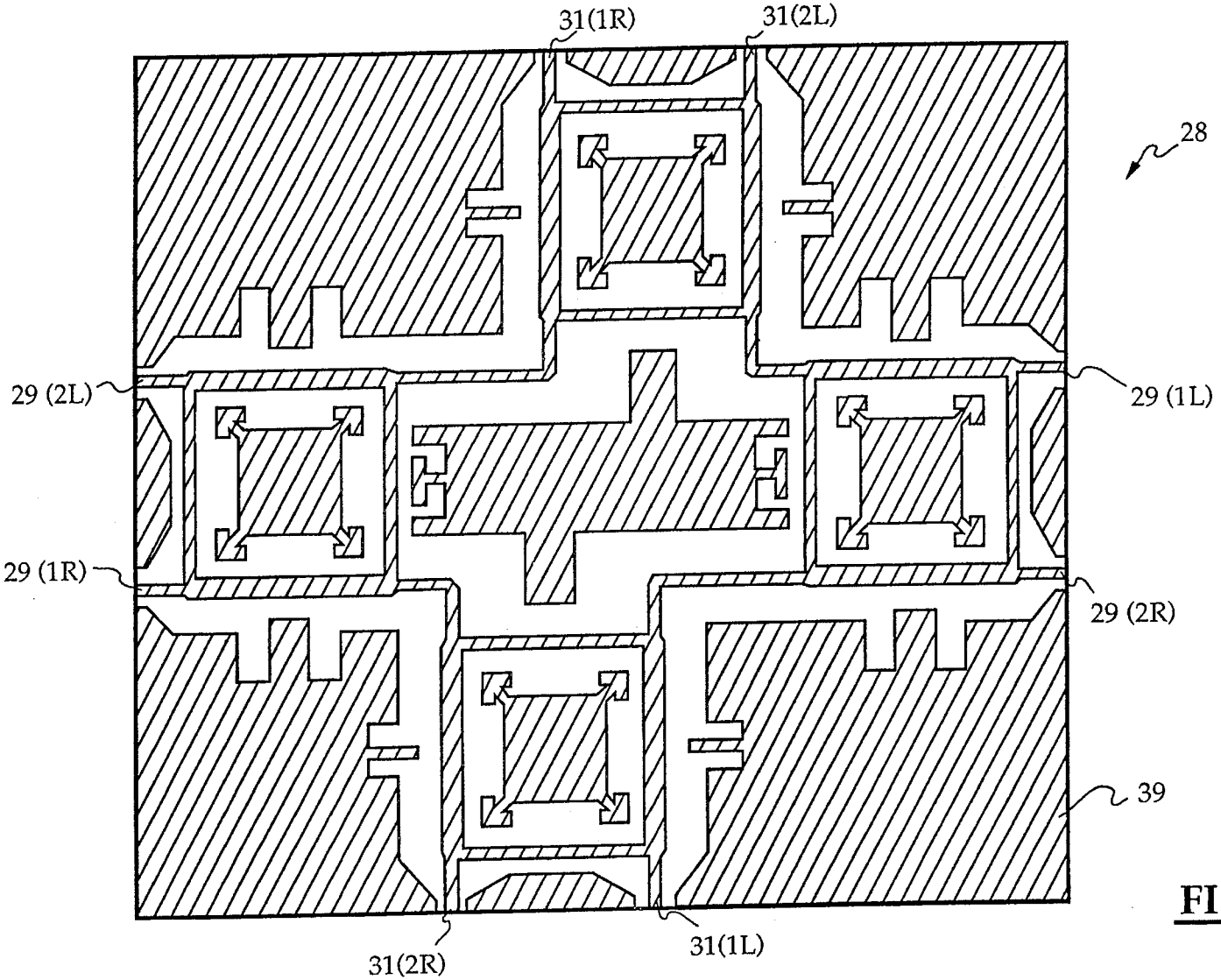
FIG. 4 is a planar view of a printed circuit board microstrip implementation of the 4-way Butler matrix feed network shown in FIG. 3.

The Butler matrix feed network 28 for use with the antenna shown in FIG. 3 is best seen in FIG. 4. This implementation uses a planar microstrip design with no crossovers and is fabricated from a printed circuit board 39 having a dielectric substrate made of low loss ceramic material, such as glass epoxy.

Butler matrix antenna ports 29 are designated 2L, 1L, 1R, and 2R, corresponding to their respective connection to co-linear array 2L, 1L, 1R and 2R. Similarly, the receiver/transmitter ports 31 are designated 2L, 1L, 1R and 2R. Each antenna and receiver/transmitter port comprises an associated coaxial connector.

Figure 5:
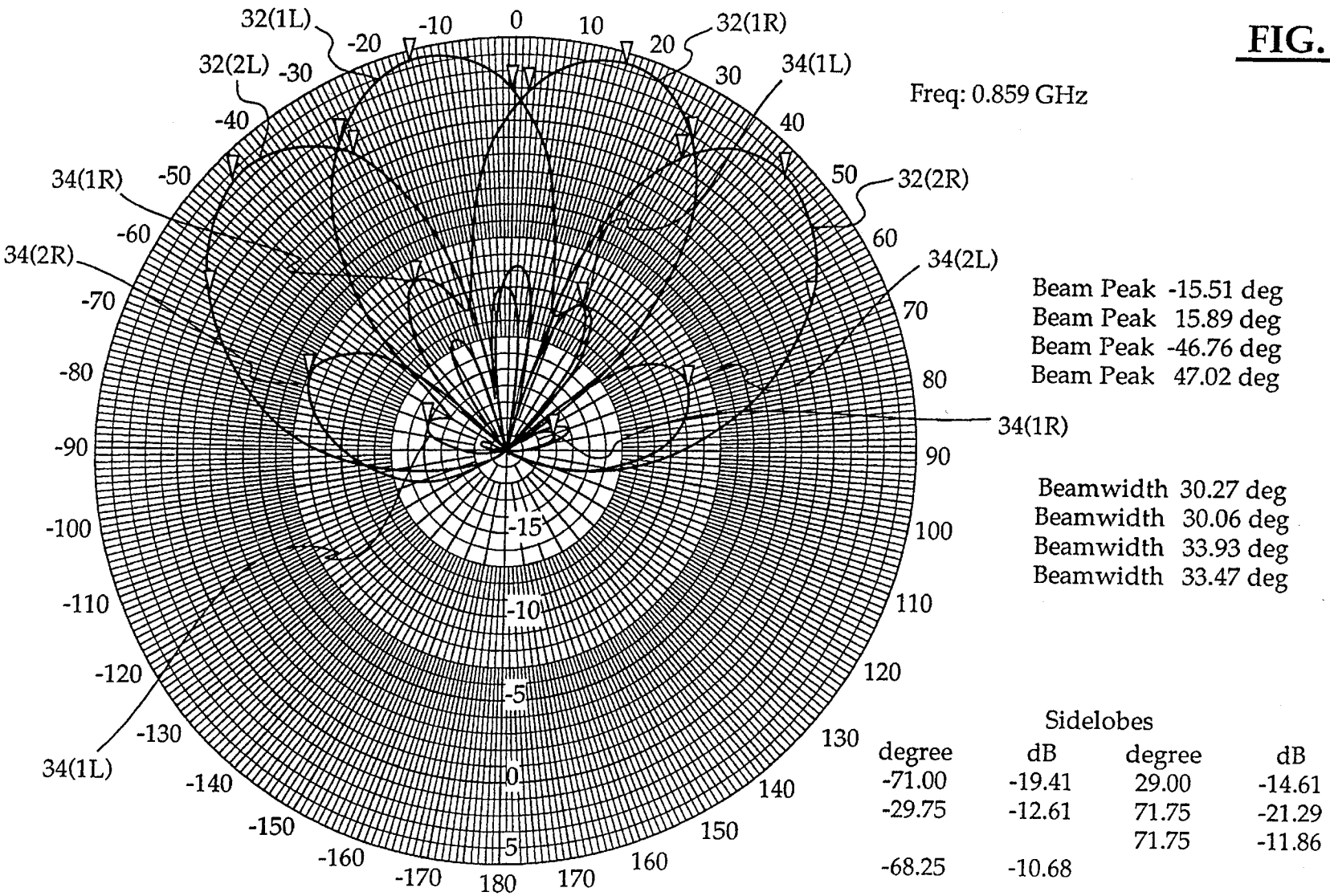
FIG. 5 illustrates the azimuthal electromagnetic radiation (energy) patterns of the four electronically steerable beams that can be generated with the antenna system shown in FIG. 3, wherein the azimuthal patterns of all four beams shown in a composite representation.

FIG. 5 illustrates the radiation pattern generated with the antenna system shown in FIG. 3 for a frequency of 859 MHz (0.859 GHz). The radiation pattern is a composite showing all four radiation beam patterns generated when the 2L, 1L, 1R and 2R Butler matrix receiver/transmitter ports 31 are respectively used. For example, if the 2L port 31 is driven by a transmitter or if energy is to be received by a receiver at this port, the antenna will have a main lobe 32, designated 2L. As seen in FIG. 5, this main lobe has a beam peak of 3.6 dB at −46.76° and a beamwidth of 33.93°. Sidelobe 34 (2L)

associated with this main lobe is at 71.75° and has a peak value of −8.26 dB, which is −11.86 dB less than the main lobe peak value. The data for all the main lobes and the highest associated sidelobes are presented in Table 1.

TABLE 1

| MAIN LOBE | BEAM PEAK POSITION (DEGREES) | BEAM WIDTH (DEGREES) |
|---|---|---|
| 2 L | −46.76 | 33.93 |
| 1 L | −15.51 | 30.27 |
| 1 R | 15.89 | 30.06 |
| 2 R | 47.02 | 33.47 |

| SIDELOBE (HIGHEST) | BEAM PEAK POSITION | DIFFERENCE BETWEEN MAIN LOBE PEAK AND SIDELOBE PEAK | |
|---|---|---|---|
| 2 L | 71.75 | (dB) | −11.86 |
| 1 L | −71.00 | (dB) | −19.41 |
| 1 L | 29.00 | (dB) | −14.61 |
| 1 R | −29.75 | (dB) | −12.61 |
| 1 R | 71.75 | (dB) | −21.29 |
| 2 R | −68.25 | (dB) | −10.68 |

Figure 6:
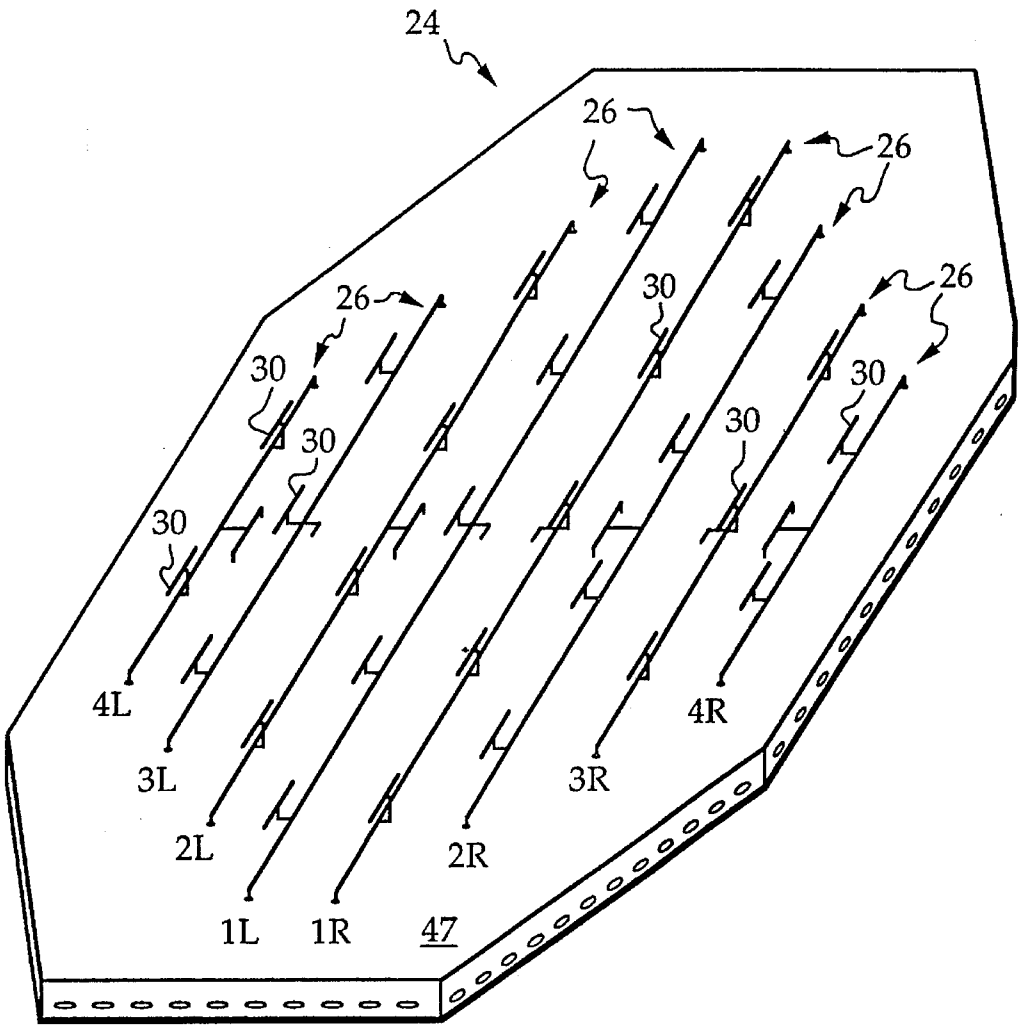
FIG. 6 is a perspective view of a space-tapered antenna for use in an antenna system according to the present invention, the antenna comprising eight co-linear arrays of radiating elements, respectively having 2, 3, 4, 5, 5, 4, 3 and 2 elements per array.

FIG. 6 illustrates a second embodiment of an antenna used in an antenna system according to the present invention which comprises eight co-linear arrays 26 identified by the notation 4L, 3L, 2L, 1L, 1R, 2R, 3R and 4R, where the L and R stand for left and right respectively. As can be seen in FIG. 6, the overall structure of this antenna is similar to that for the four co-linear array antenna shown in FIG. 3 but that the number of radiating elements is, from the 4L array to the 4R array, respectively 2, 3, 4, 5, 5, 4, 3,2.

Figure 7:
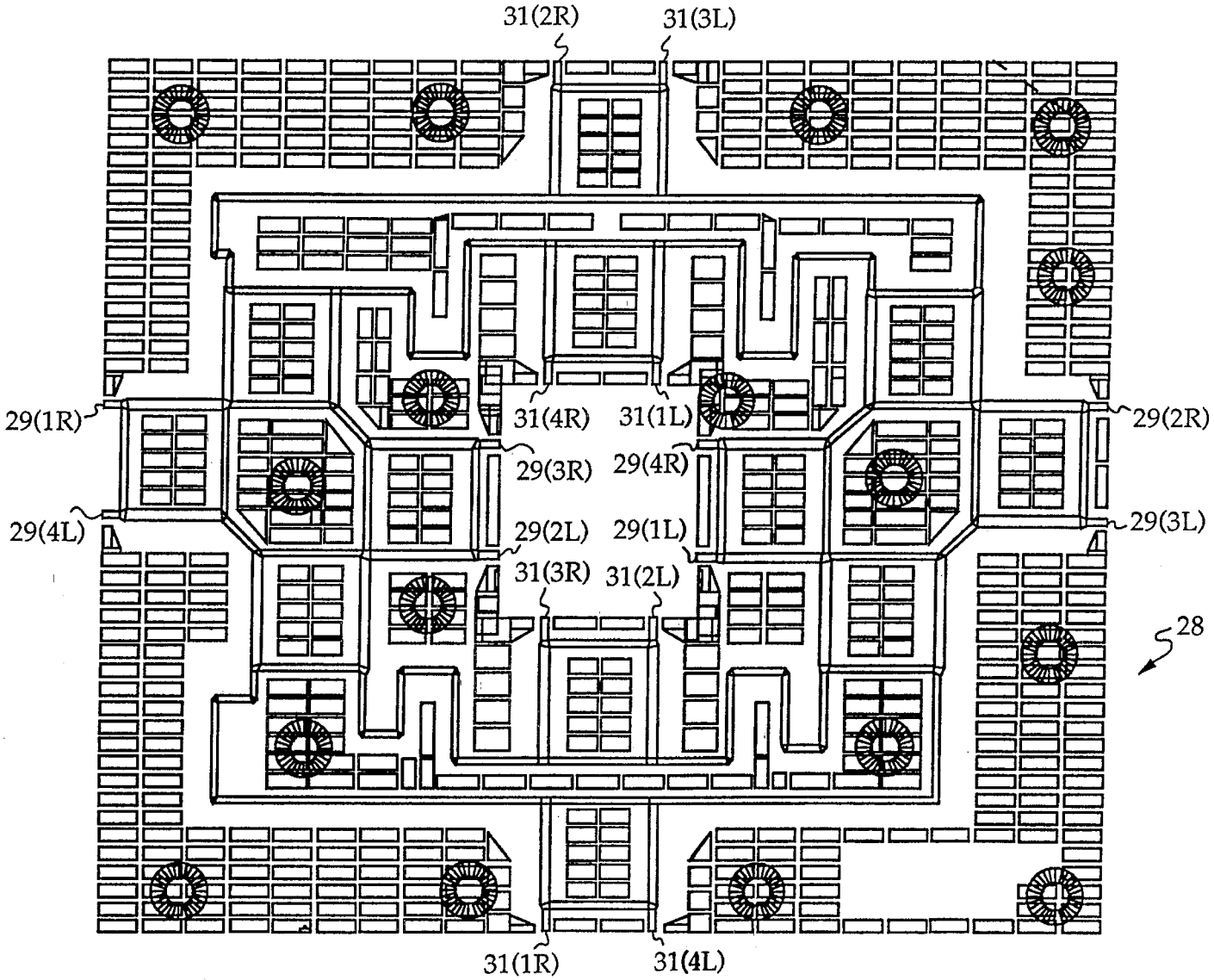
FIG. 7 is a microstrip printed circuit board layout of an 8-way Butler matrix feed network for use with the antenna shown in FIG. 6.

FIG. 7 illustrates the layout of the microstrip printed circuit board implementation of a Butler matrix feed network 28 used for connection with the antenna 24 shown in FIG. 6. Again, this printed circuit board shows no crossovers and is fabricated from a similar material as that shown in FIG. 4. The ports 29 are identified with the 4L, 3L, 2L, 1L, 1R, 2R, 3R, 4R notation corresponding to the co-linear array connections with the ports 31 for connection to the radio receiver(s) and/or transmitter(s) having a similar notation.

Figure 8:
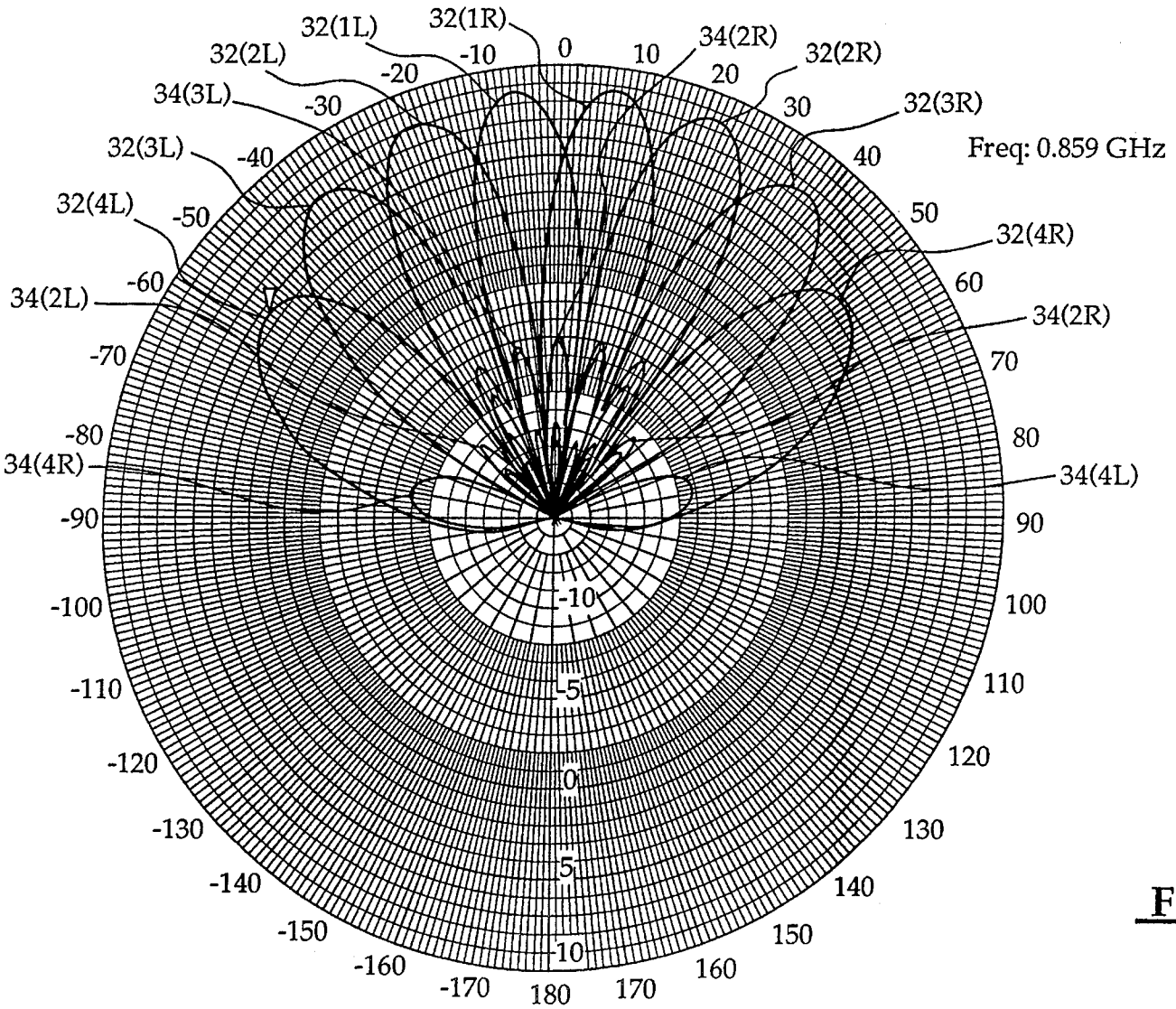
FIG. 8 is the azimuthal composite radiation pattern of an antenna system using the antenna shown in FIG. 6 with a Butler matrix feed network shown in FIG. 7.

The resulting main lobes and primary sidelobes of the antenna system using the antennas of FIG. 6 with the Butler matrix feed network of FIG. 7 is shown in composite representation in FIG. 8 for an operating frequency of 859 MHz (0.859 GHz). Thus if antenna 24 shown in FIG. 6 is driven by a transmission signal presented at port 31 of the Butler matrix at the 4L location, the main lobe of energy transmission is at main lobe 32-4L. Similarly, the main lobe of the antenna shown in FIG. 6 would be directed as shown by main lobe 32-4L if the 4L port 31 is connected to a receiver. Thus the electronic steerability of the antenna with respect to the Butler matrix feed network is similar to that illustrated with regard to the four co-linear array antenna and four-way Butler matrix feed network shown in FIGS. 3–5, except that the beamwidths for the eight co-linear array antenna system, are narrower by approximately one-half. Again, due to the space tapering of the antenna as driven by the Butler matrix feed network, sidelobe levels are significantly less than if the eight co-linear array antenna used the same number of radiating elements for each co-linear array.

It should be noted that although the number of radiating elements for the antenna shown in FIG. 3 varies from 2 to 4, back to 2 and for the eight co-linear array antenna shown in FIG. 6, varies from 2 to 5, back to 2, other number of radiating elements can be employed with a corresponding effect on the antenna gain while still maintaining significant sidelobe attenuation as compared to a co-linear array antenna using a fixed number of radiating elements for each co-linear array. Thus for example, the number of radiating elements for the four co-linear array antenna could be 1, 2, 2, 1 or 3, 4, 4, 3, or 1, 3, 3, 1, as long as the number of radiating elements toward the side periphery of the antenna is monotonically less than the number of elements toward the middle of the antenna.

Figure 9:
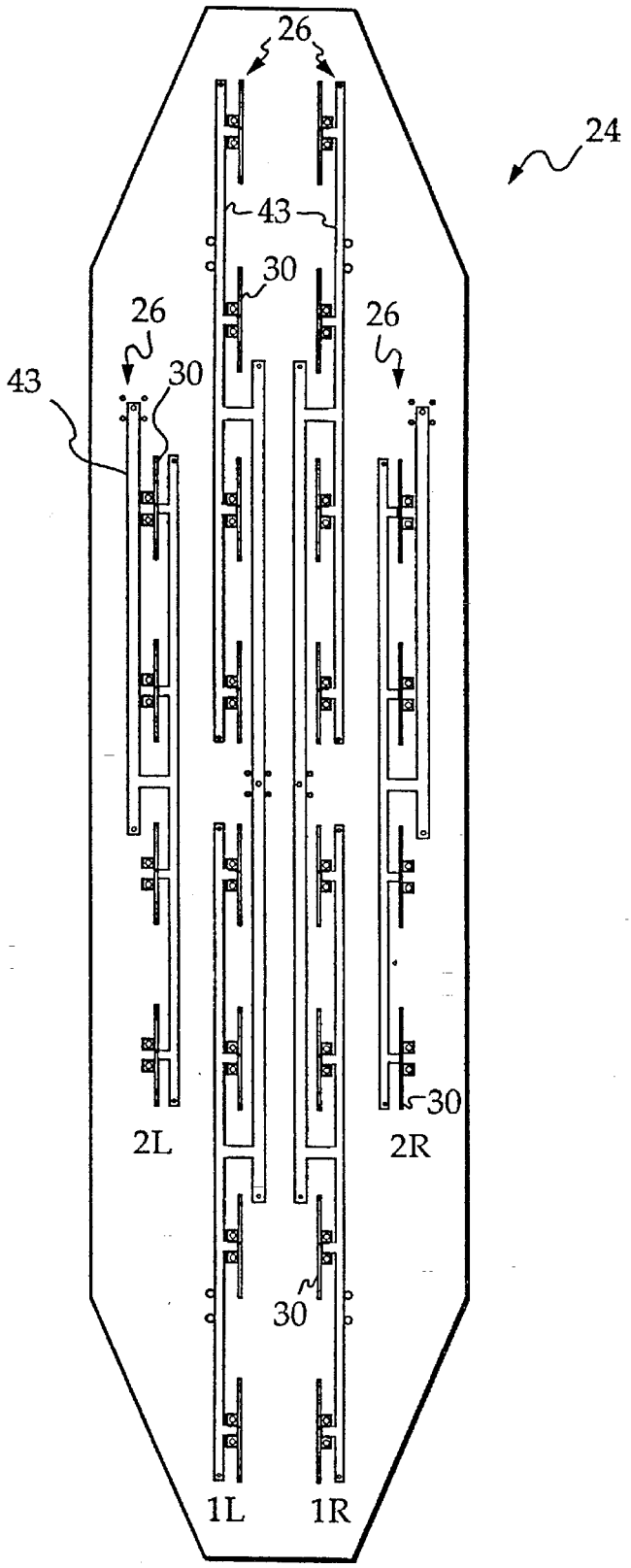
FIG. 9 is a front view of a four co-linear array antenna for use at PCS frequencies.

FIG. 9 illustrates a four co-linear array antenna similar to that shown in FIG. 3 but specifically designed for operation at personal communication system (PCS) frequencies of the order of 1.8 GHz. Here the number of radiating elements from 2L to 2R are respectively 4, 8, 8, 4. Again, the radiating elements 30 are dipoles.

Figure 10:
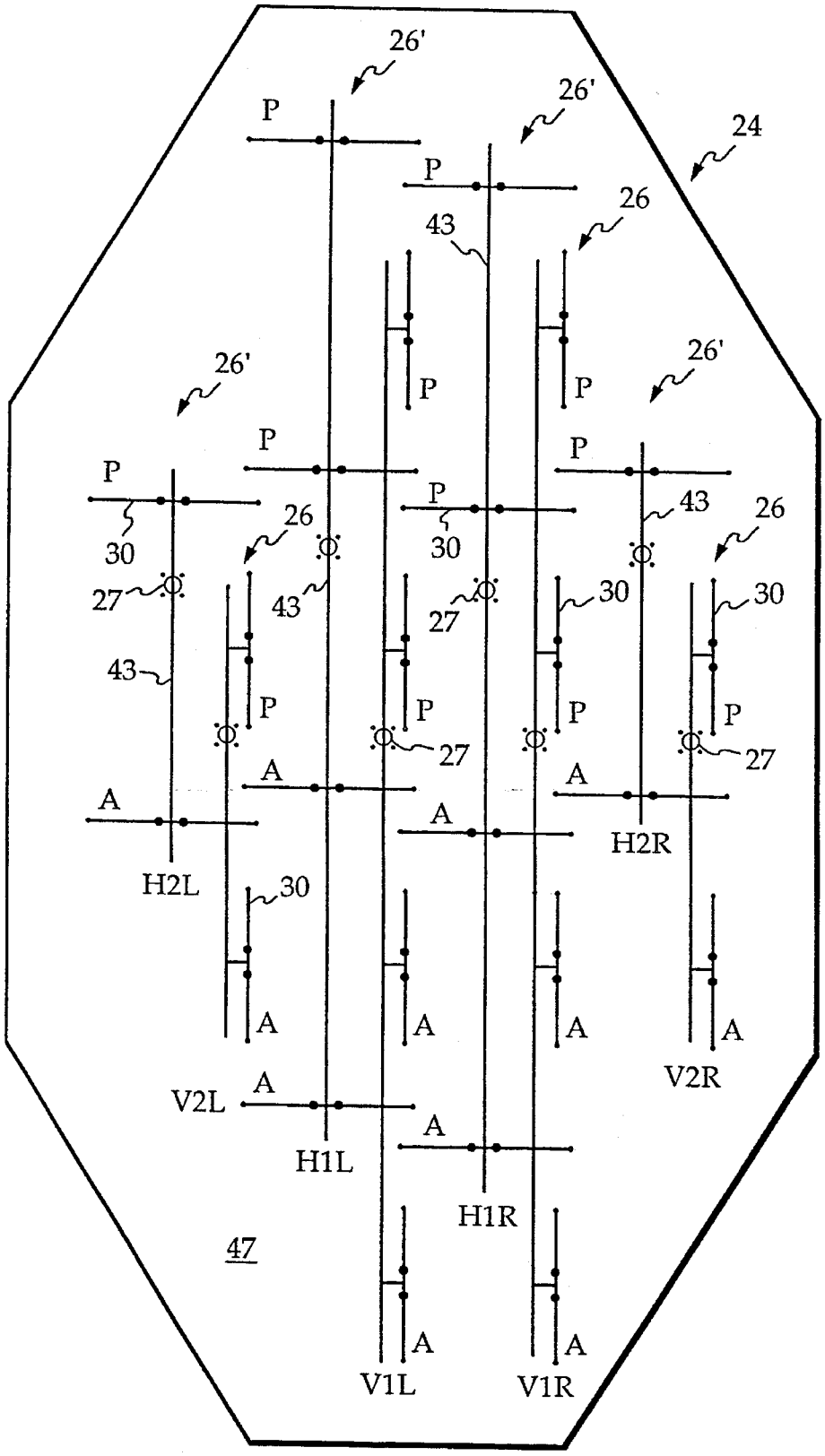
FIG. 10 is a front view of a four co-linear array antenna that radiates with dual polarization and in which the main lobe azimuthal angles are approximately the same for both polarizations.
Figure 11:
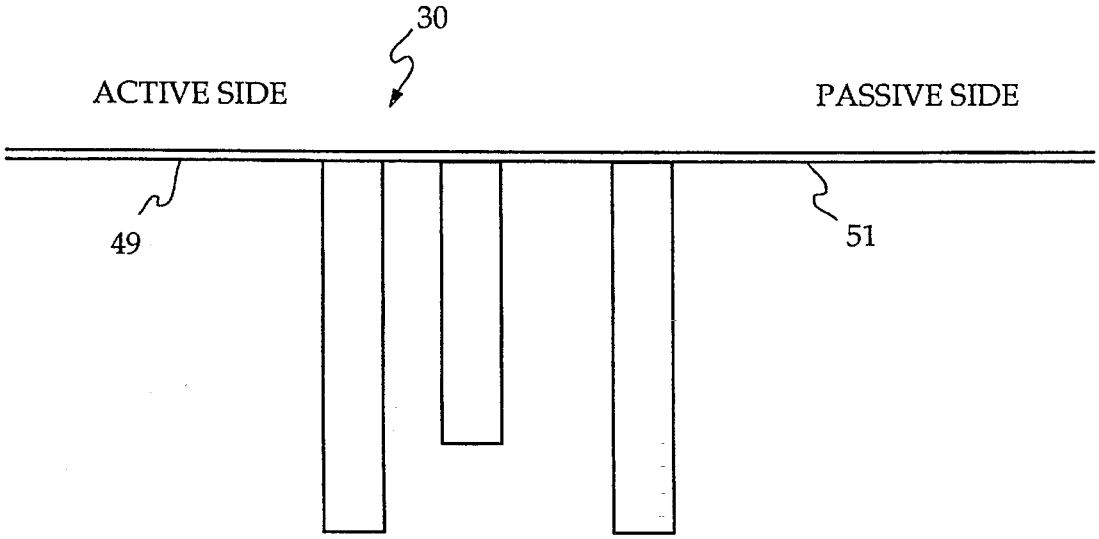
FIG. 11 is an illustration of the vertical dipole assembly used for the antenna shown in FIG. 10 as well as for the antennas shown in FIGS. 3, 6 and 9.
Figure 12:
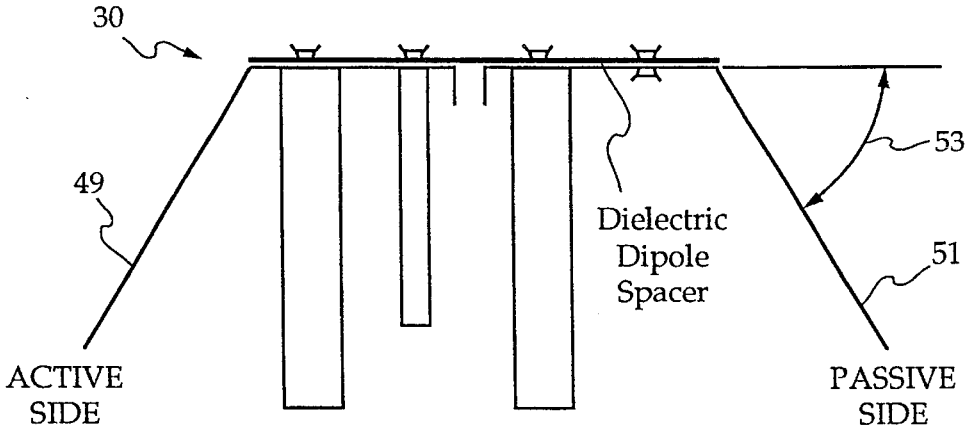
FIG. 12 is an illustration of the horizontal dipole assembly used in the dual-polarization antenna shown in FIG. 10.

FIG. 10 shows another embodiment of an antenna for use in the present antenna system invention in which the antenna comprises two sets of four co-linear arrays of radiating elements (26 and 26') for operation in both the vertical and horizontal orientations respectively. Details of the vertical dipole assembly are shown in FIG. 10 which correspond to the dipole assemblies shown for the antennas illustrated in FIGS. 3, 6 and 9, while the horizontal dipole assembly 30' is shown in FIG. 12. It is there seen that the active side 49 and the passive side 51 of these radiating elements are directed downward toward the back plane 47 of the antenna. The angle of the active and passive sides of the radiating element is approximately 59° as shown by arrow 53. The purpose for this downward angle for the active and passive sides of the horizontal dipole radiating elements is to achieve an azimuthal steerable angle commensurate with that of the vertical dipole assemblies. The arrangement shown in FIGS. 10, 11 and 12 achieves an azimuthal steerable angle of approximately 100°, whereas if the horizontal radiating elements were co-linear with respect to each other, the azimuthal steerable angle for the horizontal polarization radiating pattern would be less than 90°.

Thus what has been described is an antenna system which incorporates a space tapered antenna design comprising a plurality of co-linear arrays of radiating elements, with the number of radiating elements increasing monotonically from the side periphery of the antenna toward the co-linear arrays at the middle of the antenna, which when driven by or receiving information via a phase array feed network, such as a Butler matrix feed network, is steerable over a wide azimuthal angle so as to obtain significantly improved sidelobe attenuation as compared to antenna systems using a plurality of co-linear arrays of radiating elements with a fixed number of radiating elements per co-linear array.

It is thus seen that the objects set forth above and those made apparent from the preceding description are efficiently attained and, since certain changes may be made in the above construction without departing from the scope of the invention, it is intended that all matter contained in the above description are shown in the accompanying drawings, shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

Having described the invention, what is claimed is:

1. An antenna system (20), comprising:

A) a space-tapered multi-beam antenna (24) having:

1) N co-linear arrays (26) with innermost co-Linear arrays and outer co-linear arrays, each co-linear array having at least one electromagnetic radiating element (30), where N is an integer greater than 2, and wherein the number of radiating elements monotonically increases from the outermost co-linear arrays toward the innermost co-linear arrays to form a monotonically increasing co-linear array, 2) means (43) for connecting each radiating element within a co-linear array to all other radiating elements in the same array, and 3) an electrically conductive backplane onto which the co-linear arrays are positioned with respect thereto;

B) a microstrip fabricated phase array feed network (28) having N radio receiver/transmitter ports (31) for connection to receiver or transmitter equipment, and N antenna ports (29), each antenna port for connection to one of the N co-linear arrays (26), the phase array feed network having means for phase shifting any outgoing signal at one of the receiver/transmitter ports with respect to each of the N antenna ports, and vice versa, so as to electronically steer the radiating pattern of the antenna to any one of the N main lobes; and C) means (35) for interconnecting the antenna port (29) to the means (43) for connecting the radiating elements in each co-linear array;

whereby the antenna system radiation pattern for each of the N main lobes has one or more sidelobes that each are attenuated with respect to the corresponding main lobe by an amount greater than the sidelobes generated by an N co-linear array antenna with a fixed number of radiating elements per co-linear array.

2. An antenna system as defined in claim 1, wherein the radiating elements are dipoles.

3. An antenna system as defined in claim 2, wherein the phase array feed network is a Butler matrix feed network.

4. An antenna system as defined in claim 3, wherein the Butler matrix feed network is fabricated on a printed circuit board without crossovers.

5. An antenna system as defined in claim 4, wherein the substrate of the printed circuit board is fabricated from a low loss dielectric material.

6. An antenna system as defined in claim 5, wherein the low loss dielectric material is glass epoxy.

7. An antenna system as defined in claim 6, wherein N is 4 and wherein the number of radiating elements per co-linear array from outermost array to innermost array is respectively 2 and 4.

8. An antenna system as defined in claim 6, wherein N is 8 and wherein the number of radiating elements per co-linear array from outermost array to innermost array is respectively 2, 3, 4 and 5.

9. An improved antenna system as defined in claim 1, having a first set of N co-linear arrays, wherein the radiating elements of the first set of co-linear arrays are in a first orientation, and having a second set of N co-linear arrays, wherein the radiating elements of the second set of co-linear arrays are in a second, orthogonal orientation with respect to the radiating element of the first set of N co-linear arrays, so as to generate radiation patterns in both the vertical and horizontal orientations.

10. An antenna system, comprising:

A) a space-tapered multi-beam antenna (24) having:

1) N co-linear arrays (26), each co-linear array having at least one electromagnetic radiating element (30), where N is an integer greater than 2, the number of radiating elements monotonically increasing from the outermost co-linear arrays toward the innermost co-linear arrays, having a first set of N co-linear arrays, the radiating elements of the first set of co-linear arrays being in a first orientation, and having a second set of N co-linear arrays, the radiating elements of the second set of co-linear arrays being in a second, orthogonal orientation with respect to the radiating element of the first set of N co-linear arrays, so as to generate radiation patterns in both the vertical and horizontal orientations, the radiating elements of the first and second sets of co-linear arrays being dipoles having an active side and a passive side and wherein the radiating elements of the second set of N co-linear arrays have active and passive sides that are angled downward toward the backplane of the antenna, so as to obtain a steerable azimuthal angle commensurate with the steerable azimuthal angle of the radiating elements of the first set of co-linear arrays, 2) means (43) for connecting each radiating element within a co-linear array to all other radiating elements in the same array, and 3) an electrically conductive backplane onto which the co-linear arrays are positioned with respect thereto;

B) a microstrip fabricated phase array feed network (28) having N radio receiver/transmitter ports (31) for connection to receiver or transmitter equipment, and N antenna ports (29), each antenna port for connection to one of the N co-linear arrays (26), the microstrip fabricated phase array feed network (28) having means for phase shifting any outgoing signal at one of the receiver/transmitter ports with respect to each of the N antenna ports, and vice versa, so as to electronically steer the radiating pattern of the antenna to any one of the N main lobes; and C) means (35) for interconnecting the antenna port (29) to the means (43) for connecting the radiating elements in each co-linear array;

whereby the antenna system radiation pattern for each of the N main lobes has one or more sidelobes that each are attenuated with respect to the corresponding main lobe by an amount greater than the sidelobes generated by an N co-linear array antenna with a fixed number of radiating elements per co-linear array.

11. An antenna system as defined in claim 10, wherein the active and passive sides are angled downward toward the backplane of the antenna at an angle (53) of approximately −59 degrees.

12. An antenna system as defined in claim 1, wherein the co-linear arrays are spaced apart by approximately $\lambda/2$, where $\lambda$ is the operating frequency of the antenna.

13. An antenna system as defined in claim 12, wherein the radiating elements within each co-linear array with more than one radiating element are spaced apart by approximately $\lambda$.

14. An antenna for generating electronically steerable beams in both the vertical and horizontal orientations, with commensurate azimuthal angles, comprising:

A) a first set of N co-linear arrays (26), each co-linear array having at least one electromagnetic radiating element (30), each radiating element positioned in a first, vertical polarization orientation, where N is an integer greater than 2, and wherein the number of radiating elements monotonically increases from the outermost co-linear arrays to the innermost co-linear arrays;

B) a second set of N co-linear arrays (26'), each co-linear array having at least one electromagnetic radiating element (30), each radiating element positioned in a second, horizontal polarization orientation that is orthogonal with respect to the radiating elements of the first set of co-linear arrays;

C) means (43) for connecting each radiating element within a co-linear array to all other radiating elements in the same array; and D) an electrically conductive backplane onto which the co-linear arrays are positioned with respect thereto; and wherein the radiating elements of the first and second sets of co-linear arrays are dipoles having an active side (49) and a passive side (51), wherein the active and passive sides of the radiating elements of the first set of co-linear arrays are co-linear with respect to each other, and wherein the active and passive sides of the radiating elements of the second set of co-linear arrays are each angled downward toward the backplane of the antenna.

15. An improved antenna system as defined in claim 14, wherein the active and passive sides of the horizontal radiating elements are angled downward toward the backplane of the antenna at an angle (53) of approximately –59 degrees.

* * * * *